US011325242B1

(12) United States Patent
Chen

(10) Patent No.: US 11,325,242 B1
(45) Date of Patent: May 10, 2022

(54) TOOLBOX

(71) Applicant: MING SHIN TOOLS CO., LTD., Taichung (TW)

(72) Inventor: Yung-Shun Chen, Taichung (TW)

(73) Assignee: MING SHIN TOOLS CO., LTD., Taichung (TW)

( * ) Notice: Subject to any disclaimer, the term of this patent is extended or adjusted under 35 U.S.C. 154(b) by 0 days.

(21) Appl. No.: 17/215,736

(22) Filed: Mar. 29, 2021

(51) Int. Cl.
*B25H 3/02* (2006.01)

(52) U.S. Cl.
CPC ..... *B25H 3/023* (2013.01); *B25H 3/022* (2013.01)

(58) Field of Classification Search
CPC ..... B25H 3/023; B25H 3/027; B25H 3/028; B25H 3/026; B25H 3/025; B25H 3/022; B25H 3/02; B25H 3/00; B25H 1/04; B25H 1/12; B25H 3/021; B25H 3/003; B65D 21/0212; B65D 21/023
USPC ..... 206/349, 373, 372, 510
See application file for complete search history.

(56) References Cited

U.S. PATENT DOCUMENTS 1,984,345 A * 12/1934 Kennedy ..... B25H 3/02 312/290
2,286,427 A * 6/1942 Levensten ..... B25H 3/02 312/222
4,662,515 A * 5/1987 Newby, Sr. ..... B25H 3/02 206/349
4,775,199 A * 10/1988 Lanius ..... B25H 3/028 312/216
5,244,265 A * 9/1993 Chiang ..... B25H 3/023 312/107
5,738,423 A * 4/1998 Alfaro ..... A63H 33/3072 312/244
5,882,097 A * 3/1999 Kohagen ..... B25H 3/023 312/235.1
6,637,592 B1 * 10/2003 Lai ..... B25H 3/023 206/372
6,719,380 B1 * 4/2004 Liu ..... B25H 3/028 312/217
7,832,584 B2 * 11/2010 Eggers ..... B25H 3/023 220/7
9,744,663 B2 * 8/2017 Lin ..... B62B 3/002
9,962,826 B1 * 5/2018 Surridge ..... B25H 3/028
10,182,628 B2 * 1/2019 Tonelli ..... A45C 5/03
2002/0125159 A1 * 9/2002 Hann ..... E04F 21/20 206/372

(Continued)

*Primary Examiner* — Steven A. Reynolds
*Assistant Examiner* — Prince Pal
(74) *Attorney, Agent, or Firm* — Muncy, Geissler, Olds & Lowe, PC

(57) ABSTRACT

A toolbox is provided, including a main body, a lid and at least on locking assembly. The main body has a first flange and a first frame. The first frame is disposed on the first flange. The cover has a second flange and a second frame. The second frame is disposed on the second flange. At least one tray or drawer is disposed in the main body. The at least one locking assembly has a first locking unit, a second locking unit, first positioning members and second positioning members. The first locking unit is positioned on the first frame by the first positioning members. The second locking unit is positioned on the second frame by the second positioning members. Each first positioning member is disposed through two side of the first flange. Each second positioning member is disposed through two sides of the second flange.

10 Claims, 13 Drawing Sheets

(56) References Cited

U.S. PATENT DOCUMENTS

| | | | | |
|---|---|---|---|---|
| 2003/0075468 | A1* | 4/2003 | Story | B25H 3/02 206/373 |
| 2003/0155729 | A1* | 8/2003 | Chen | A47G 23/0225 280/47.35 |
| 2004/0160150 | A1* | 8/2004 | Hay | B25H 3/028 312/281 |
| 2004/0168941 | A1* | 9/2004 | Cho | A45C 11/24 206/373 |
| 2004/0188296 | A1* | 9/2004 | Chen | B25H 3/026 206/370 |
| 2008/0121542 | A1* | 5/2008 | Chang | B25H 3/028 206/349 |
| 2010/0108549 | A1* | 5/2010 | Eggers | B25H 3/028 206/349 |
| 2010/0224527 | A1* | 9/2010 | Huang | B25H 3/028 206/503 |
| 2013/0284773 | A1* | 10/2013 | Meng | B25H 3/003 224/196 |
| 2016/0008972 | A1* | 1/2016 | Chen | B25H 3/023 206/373 |
| 2016/0130034 | A1* | 5/2016 | Kuhls | B25H 3/023 206/510 |
| 2016/0309863 | A1* | 10/2016 | Tonelli | B25H 3/028 |
| 2017/0173782 | A1* | 6/2017 | Chen | B25H 3/028 |
| 2018/0200875 | A1* | 7/2018 | Wolle | B25H 3/028 |
| 2018/0200876 | A1* | 7/2018 | Wolle | B25H 3/02 |
| 2019/0039233 | A1* | 2/2019 | Liu | E05B 65/462 |

* cited by examiner

TOOLBOX

BACKGROUND OF THE INVENTION

Field of the Invention

The present invention relates to a toolbox.

Description of the Prior Art

Generally, when fixing objects, drive tools (such as wrenches, sockets, screwdrivers or the like) are used to drive fasteners or connectors for assembling/disassembling. However, there are a variety of sizes and types of drive tools, so that toolboxes are often used for easy storage and carrying of the drive tools.

However, the structural strength of the toolbox made of plastic is weak. When locking members, hinges and other connecting elements are attached to the toolbox, it can cause the damage to the structure of the toolbox and can make the toolbox fragile. After the toolbox is used for a period of time, portions of the toolbox on which the locking members, hinges and connecting elements are mounted are easy to bend, deform and/or break off, which results in a shorter service life.

The present invention is, therefore, arisen to obviate or at least mitigate the above-mentioned disadvantages.

SUMMARY OF THE INVENTION

The main object of the present invention is to provide a toolbox which has good structural strength and light weight.

To achieve the above and other objects, a toolbox is provided, including: a main body, including a main frame, a storing tray, at least one drawer, a first flange and a first frame, the main frame defining an inner space, a first opening and a second opening which are in communication with the inner space, the storing tray being disposed on the main frame and covering the first opening, at least one of the storing tray and the main frame including an annular face, the first flange projecting from the annular face in a direction toward the first opening, the first frame including two first side walls and a first end wall, the two first side walls being respectively connected to opposite ends of the first end wall to define a first receiving room, the first flange being inserted within the first receiving room, the at least one drawer being inserted within the inner space via the second opening and mounted to the main frame, the first frame being made of metal, the first flange being made of plastic material; a lid, rotatably connected to the main body, including a second flange and a second frame, the second frame including two second side walls and a second end wall, the two second side walls being respectively connected to opposite ends of the second end wall to define a second receiving room, the second flange being inserted within the second receiving room, the second frame being made of metal, the second flange being made of plastic material; and at least one locking assembly, including a first locking unit, a second locking unit, a plurality of first positioning members and a plurality of second positioning members, the first locking unit being positioned to the first frame by the plurality of first positioning members, the second locking unit being positioned to the second frame by the plurality of second positioning members, the first locking unit being lockable with the second locking unit to releasably lock the lid and the main body; wherein each said first positioning member including a first shaft and two first blocking portions, the first shaft being disposed through the first locking unit, the first flange and the two first side walls, the two first blocking portions being respectively connected to opposite ends of the first shaft, the two first blocking portions being respectively blockable with the first locking unit and one said first side wall in a direction in which the first shaft extends; wherein each said second positioning member including a second shaft and two second blocking portions, the second shaft being disposed through the second locking unit, the second flange and the two second side walls, the two second blocking portions being respectively connected to opposite ends of the second shaft, the two second blocking portions being respectively blockable with the second locking unit and one said second side wall in a direction in which the second shaft extends.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
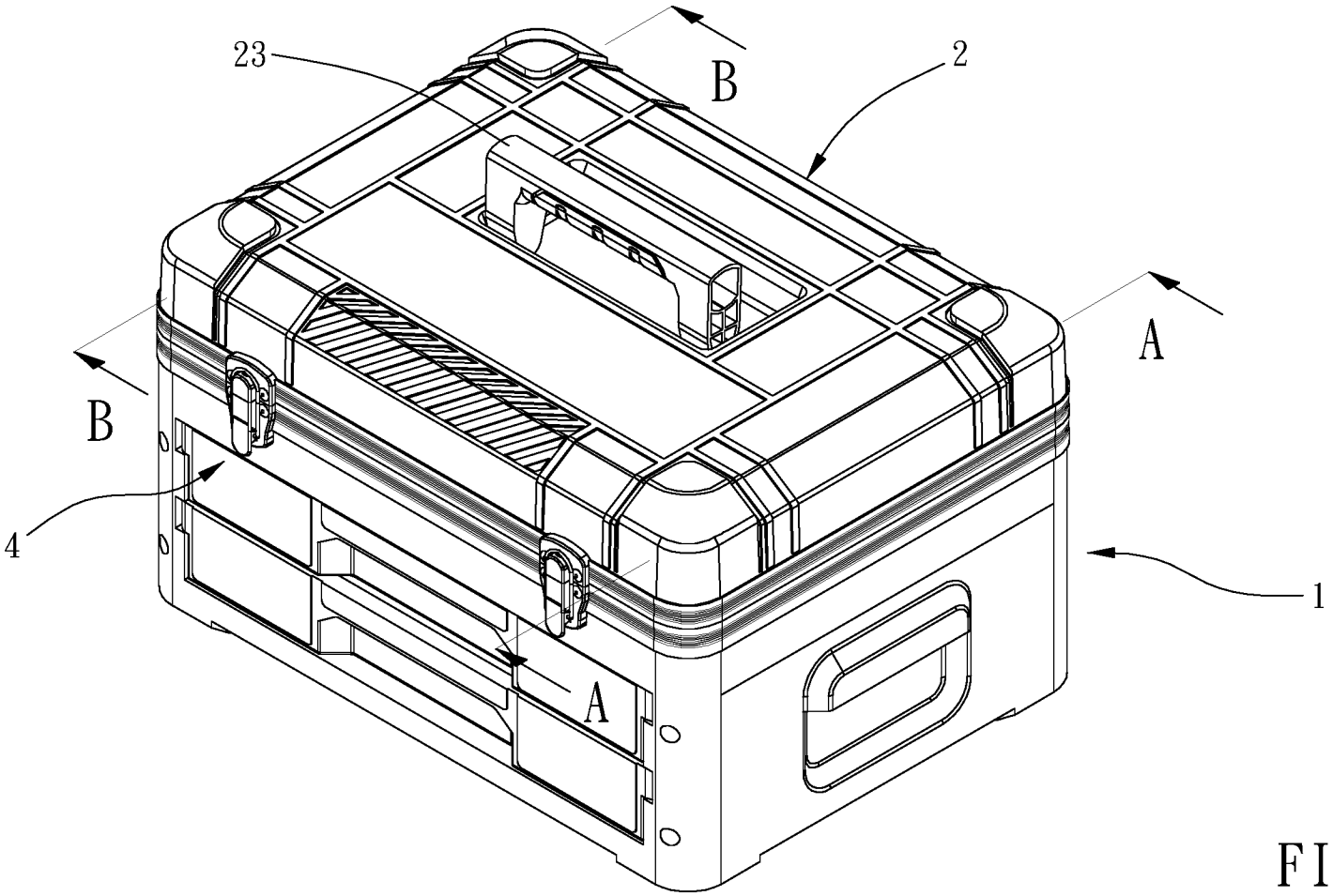
FIG. 1 is a stereogram of a preferable embodiment of the present invention.
Figure 2:
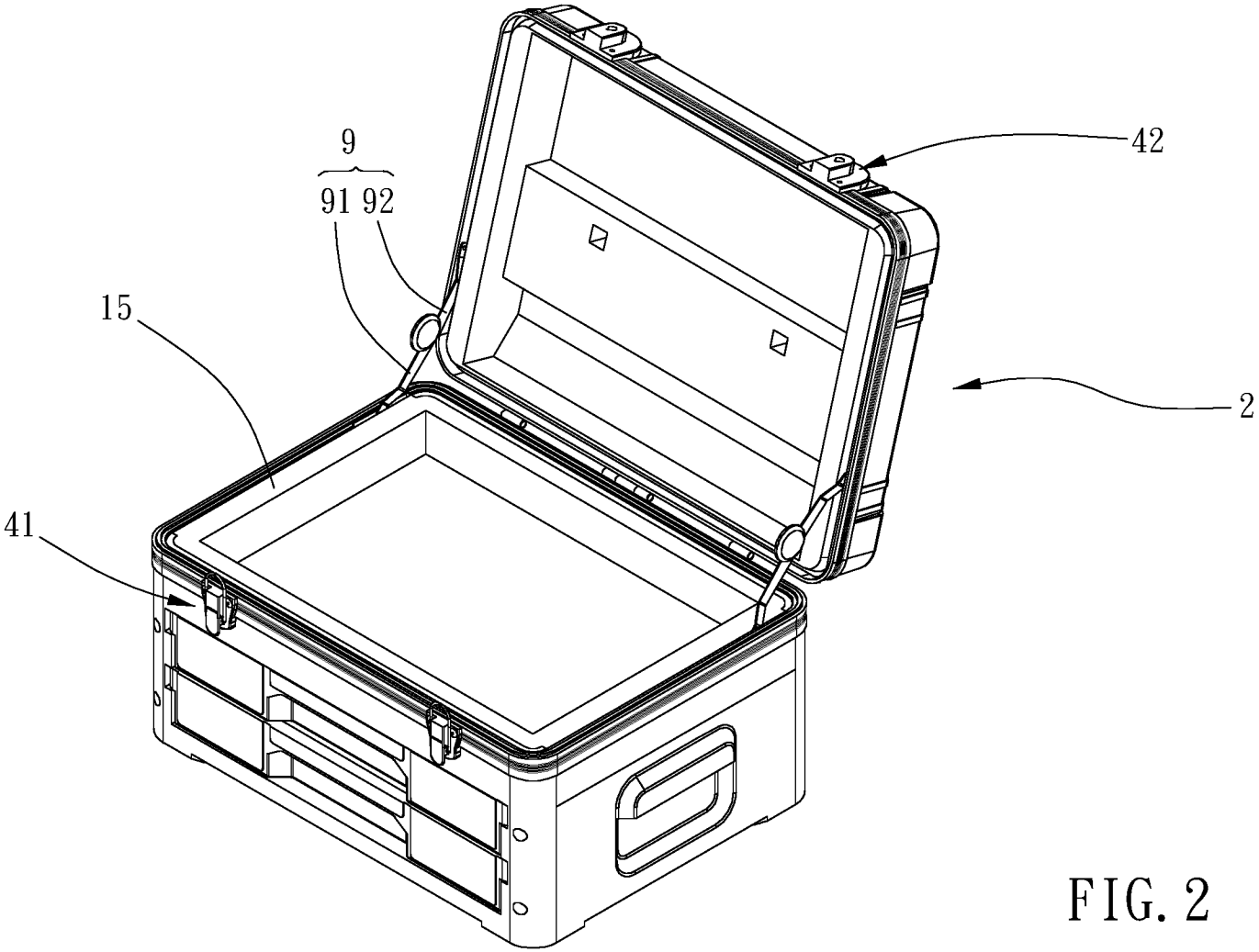
FIG. 2 is a drawing showing a toolbox in open state according a preferable embodiment of the present invention.
Figure 3:
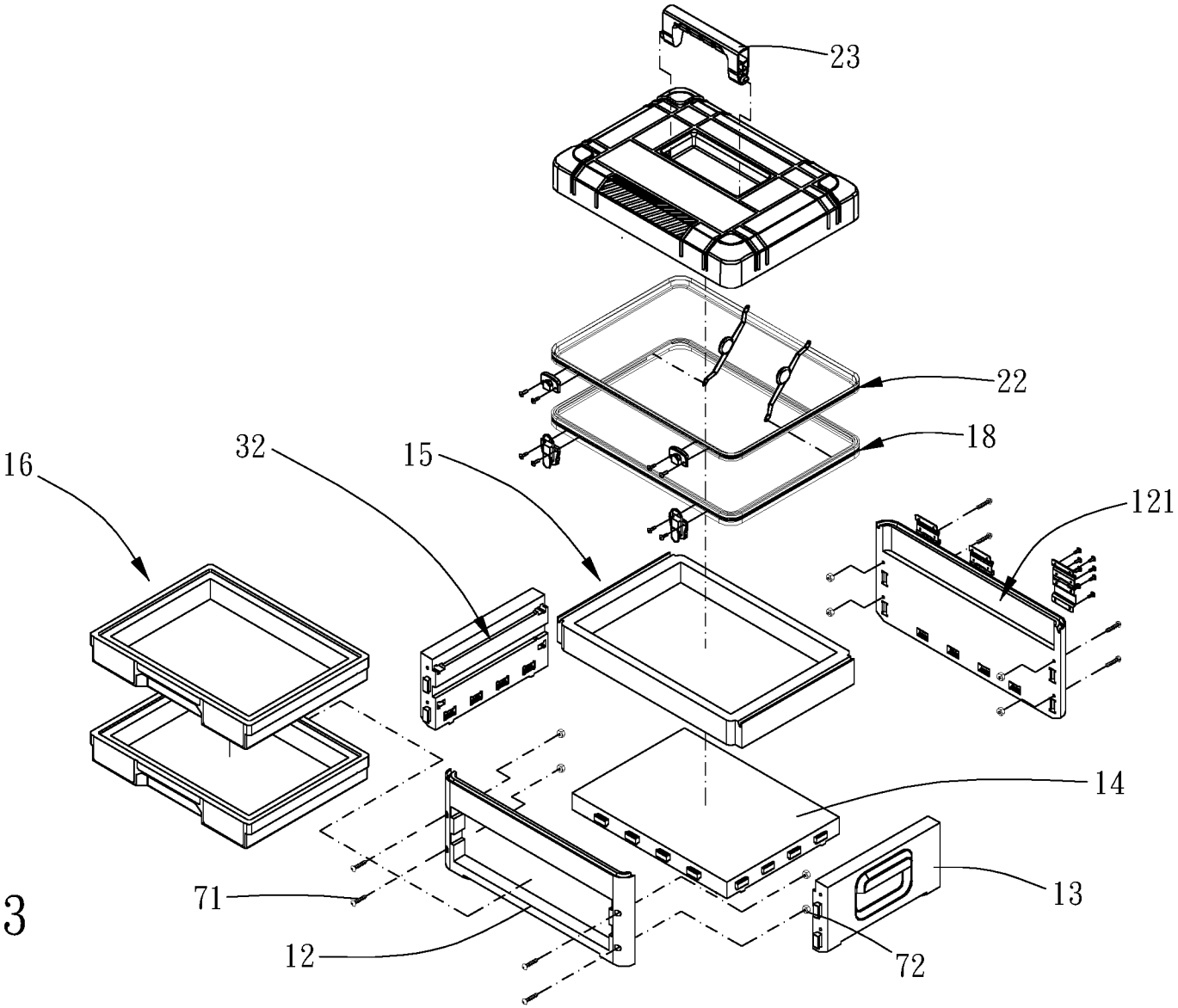
FIG. 3 is a breakdown drawing of FIG. 1.
Figure 4:
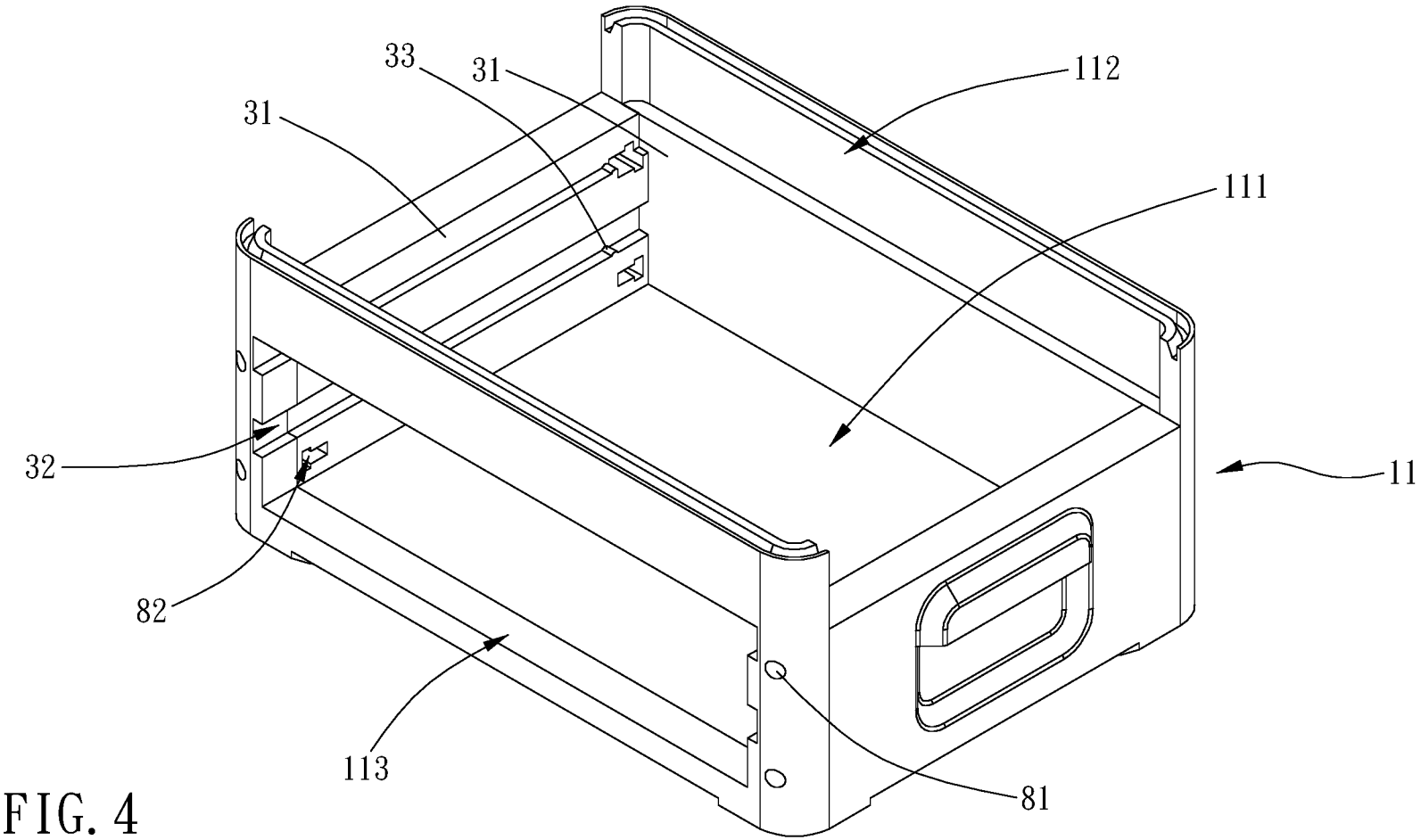
FIG. 4 is a drawing showing a main frame of a preferable embodiment of the present invention.
Figure 5:
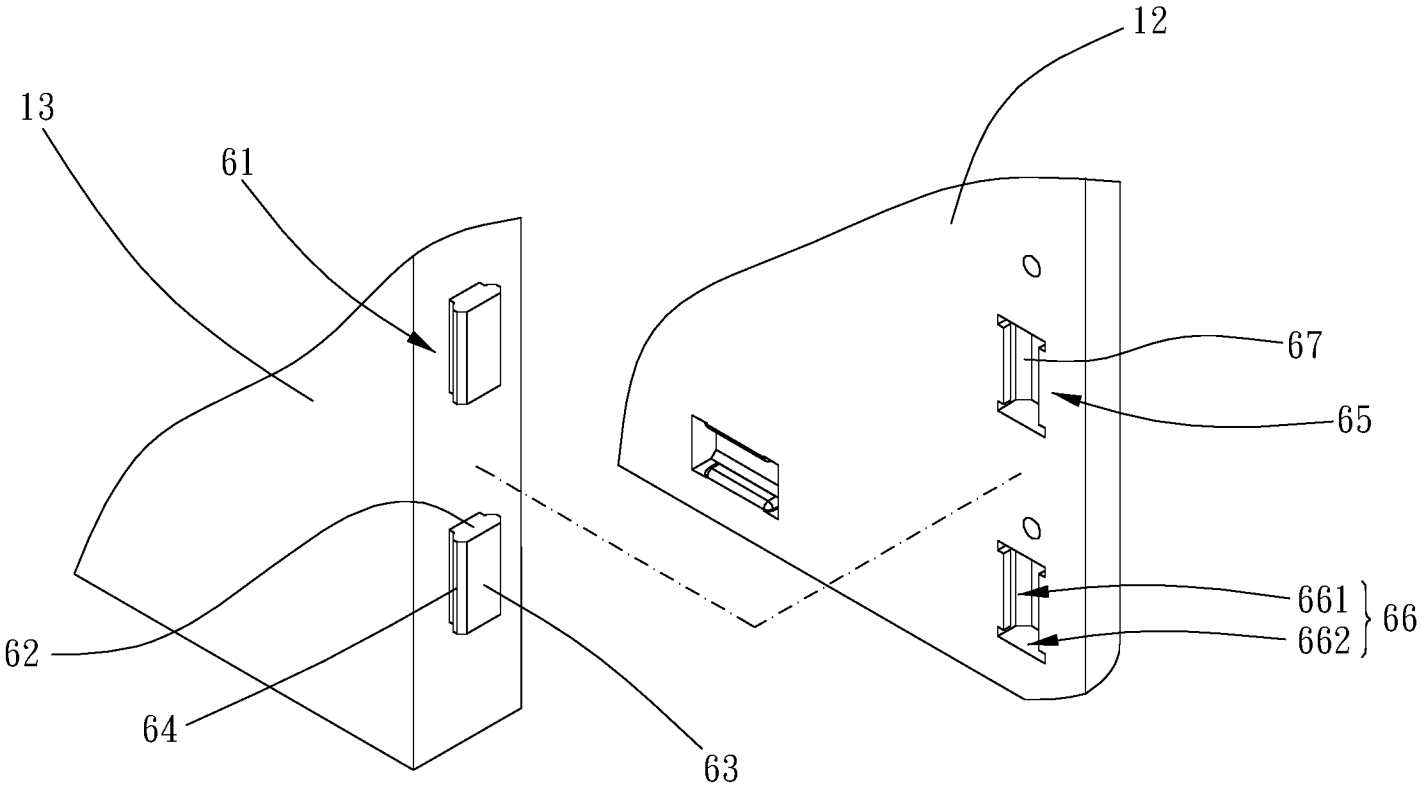
FIG. 5 is a drawing showing a connection projection and a connection recess of a preferable embodiment of the present invention.
Figure 6:
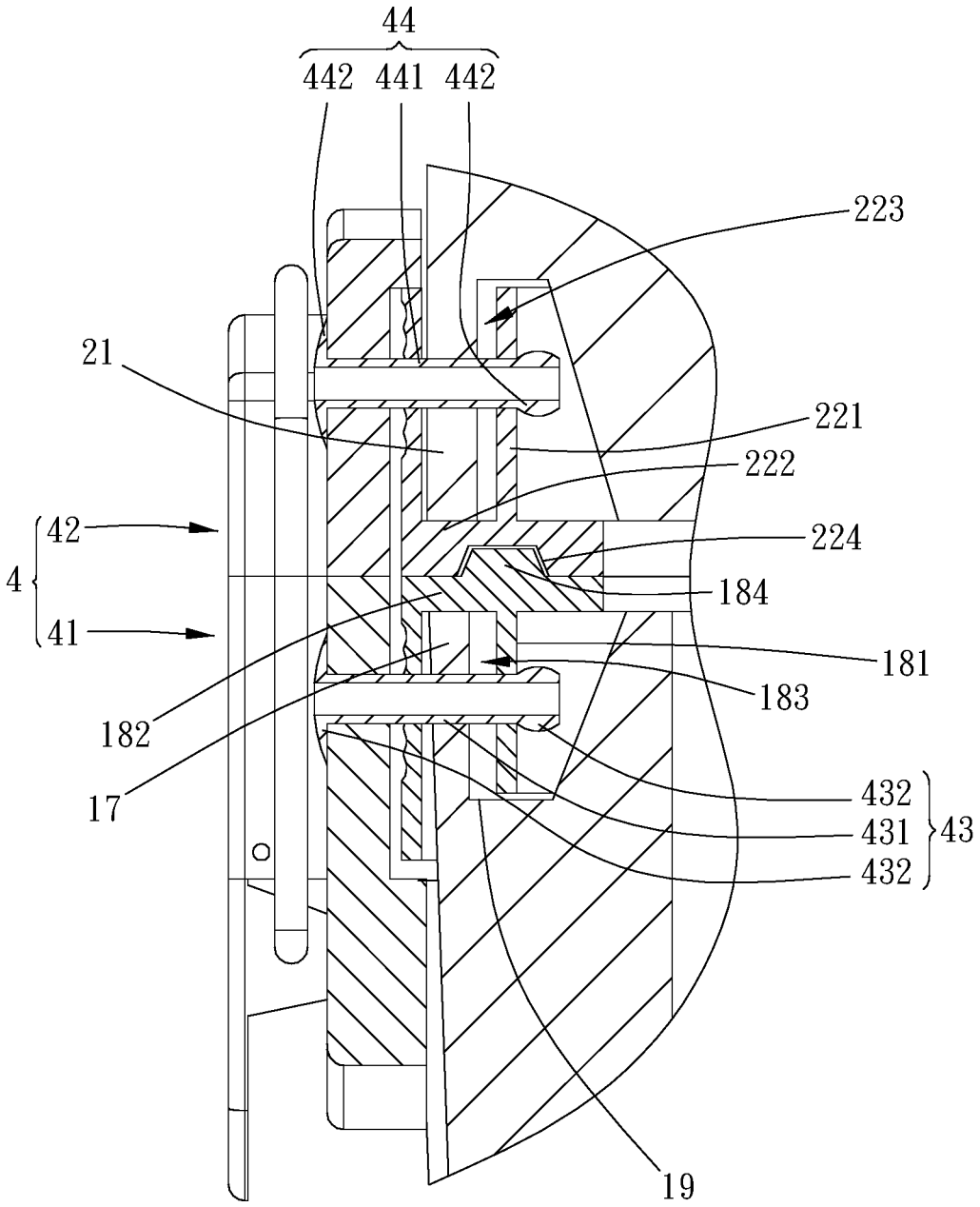
FIG. 6 is a cross-sectional view showing a locking assembly of a preferable embodiment of the present invention.
Figure 7:
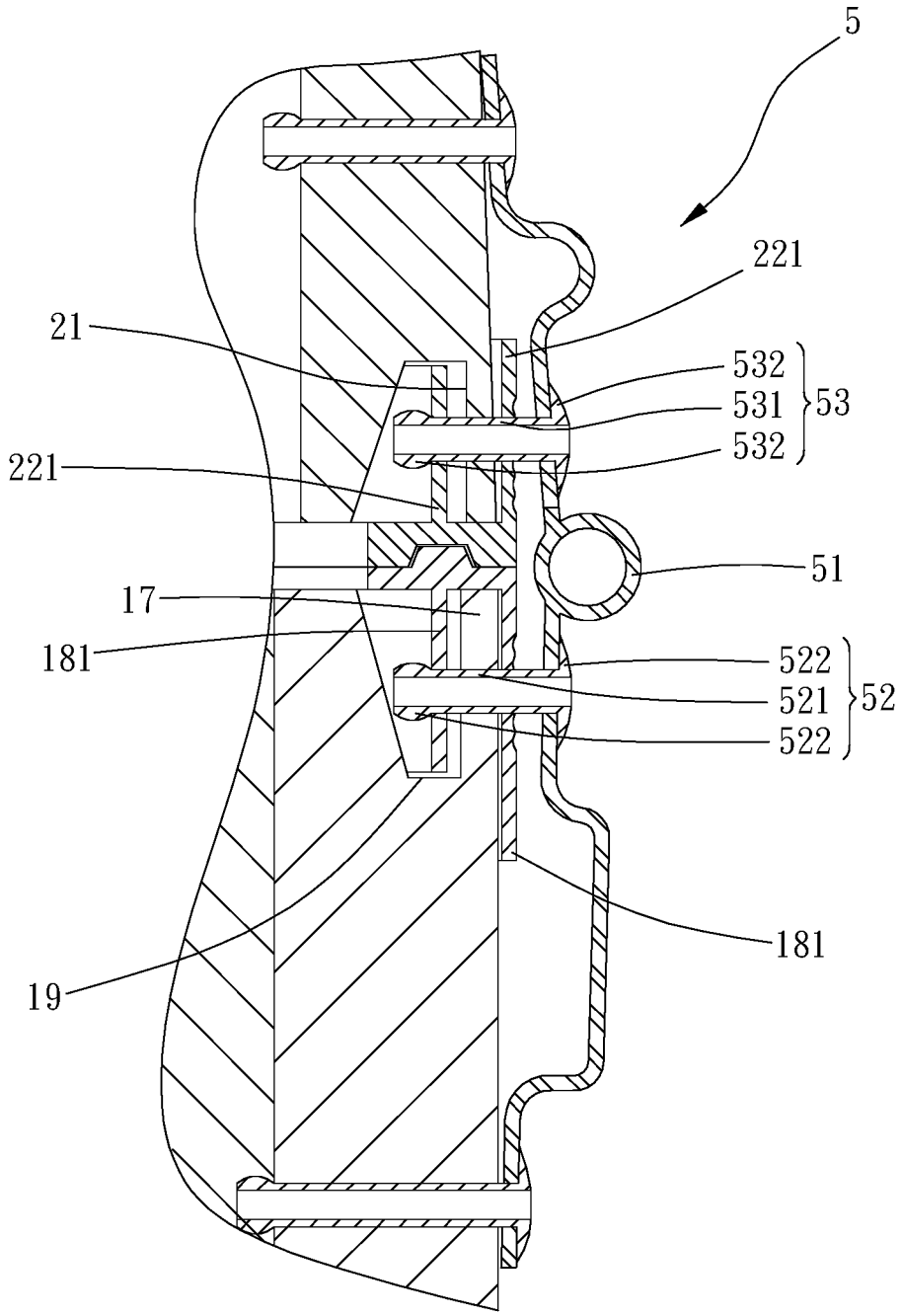
FIG. 7 is a cross-sectional view showing a hinged portion of a preferable embodiment of the present invention.
Figure 8:
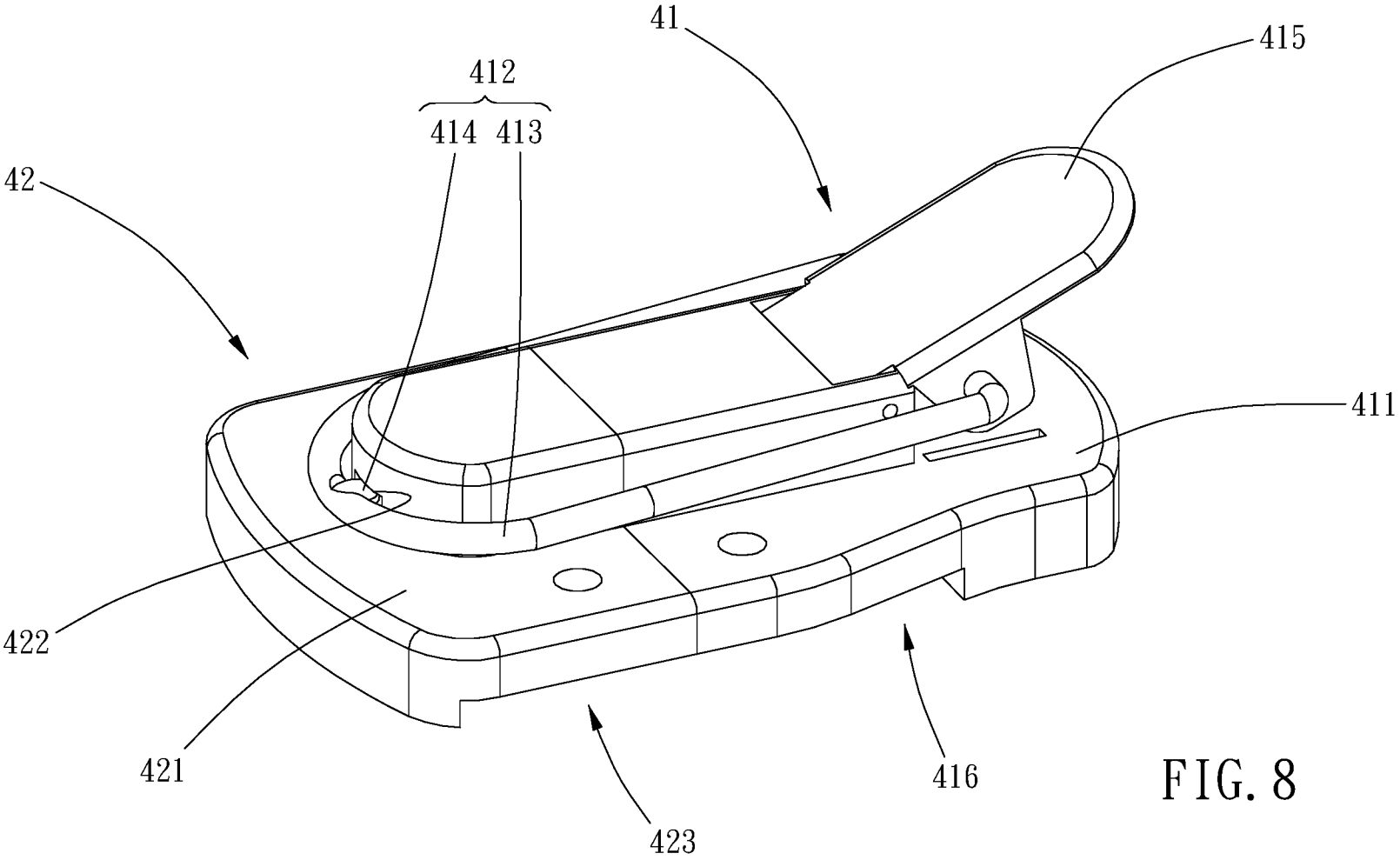
FIG. 8 is a stereogram of a locking assembly of a preferable embodiment of the present invention.
Figure 9:
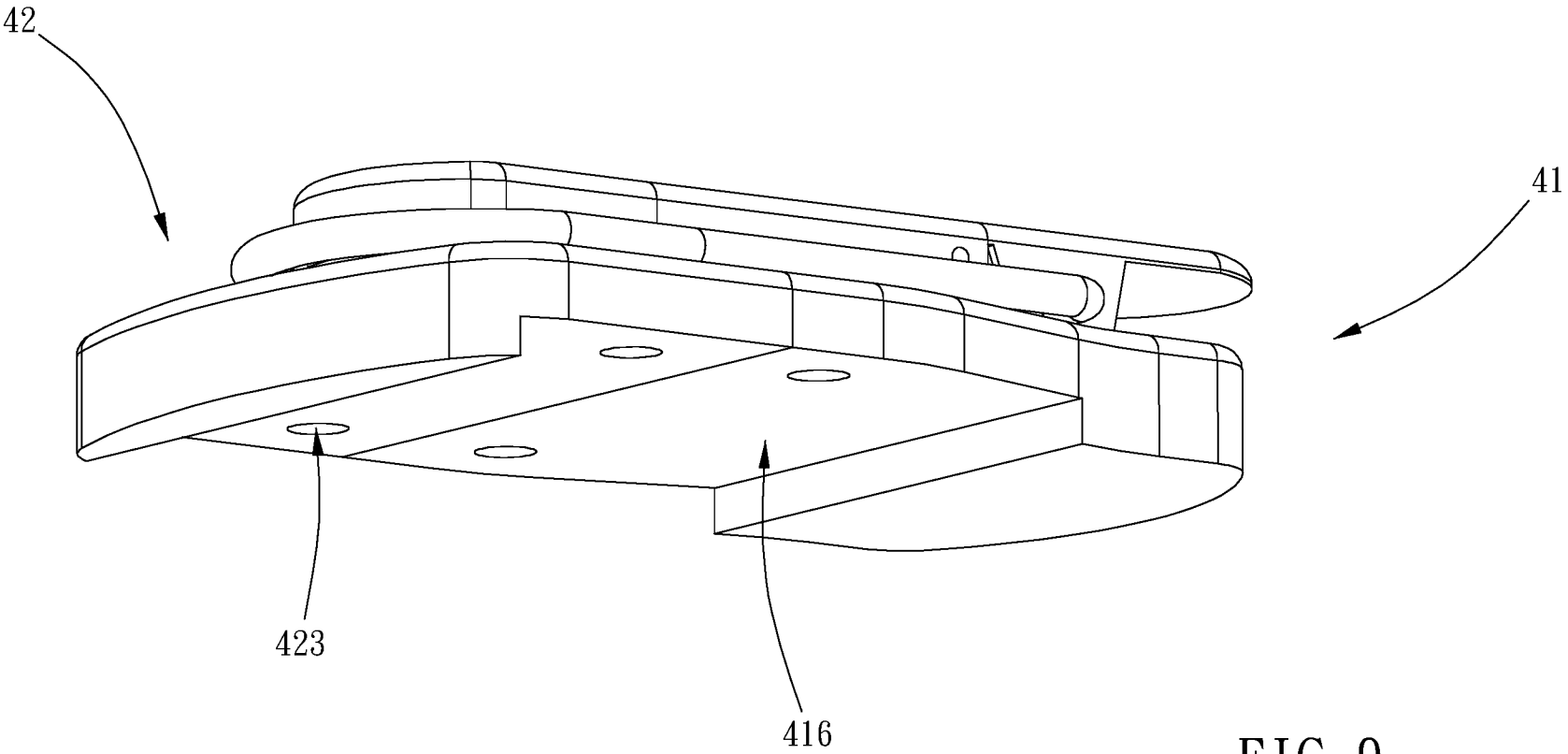
FIG. 9 is another stereogram of the locking assembly of a preferable embodiment of the present invention.
Figure 10:
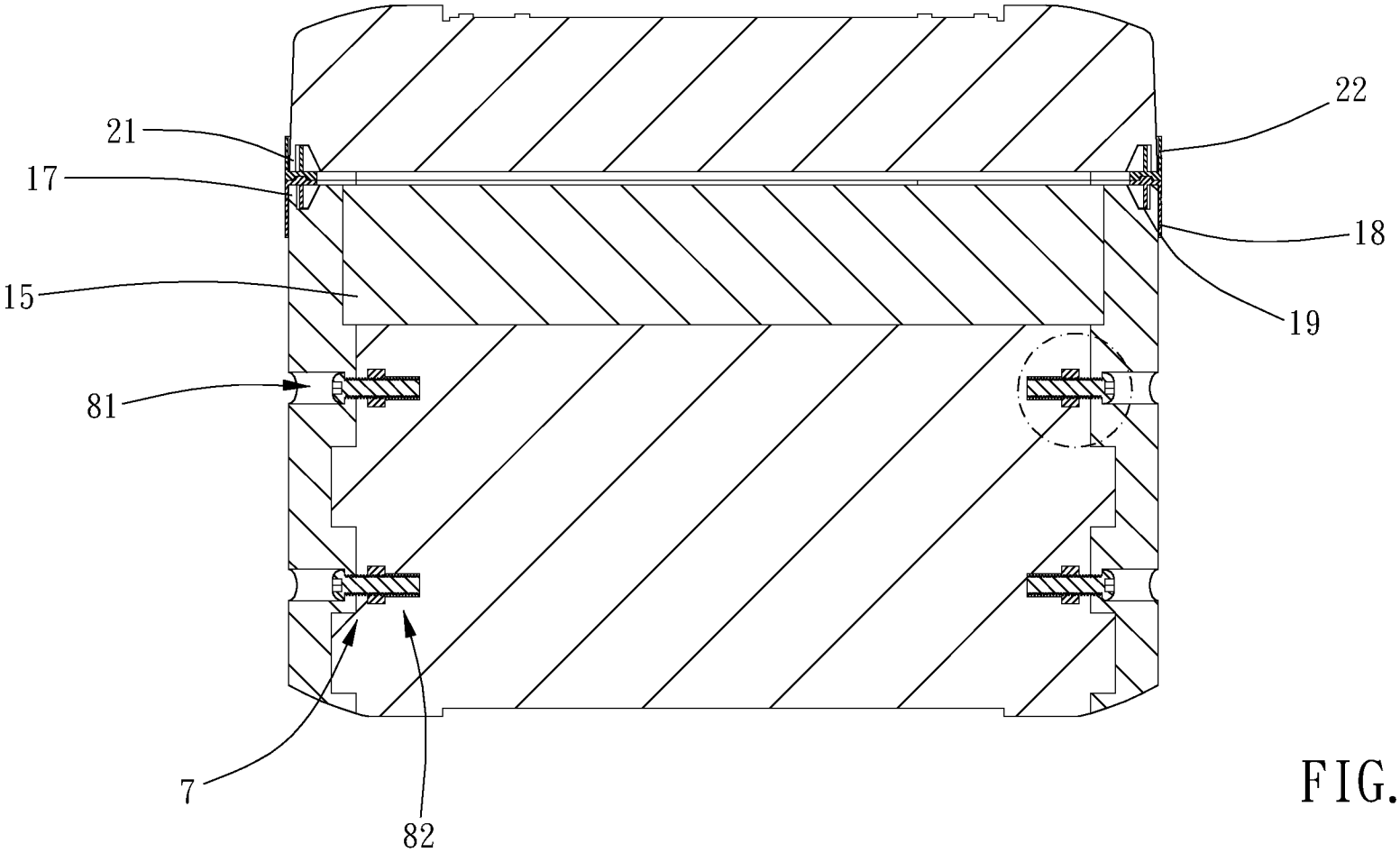
FIG. 10 is a cross-sectional view, taken along a line A-A of FIG. 1.
Figure 11:
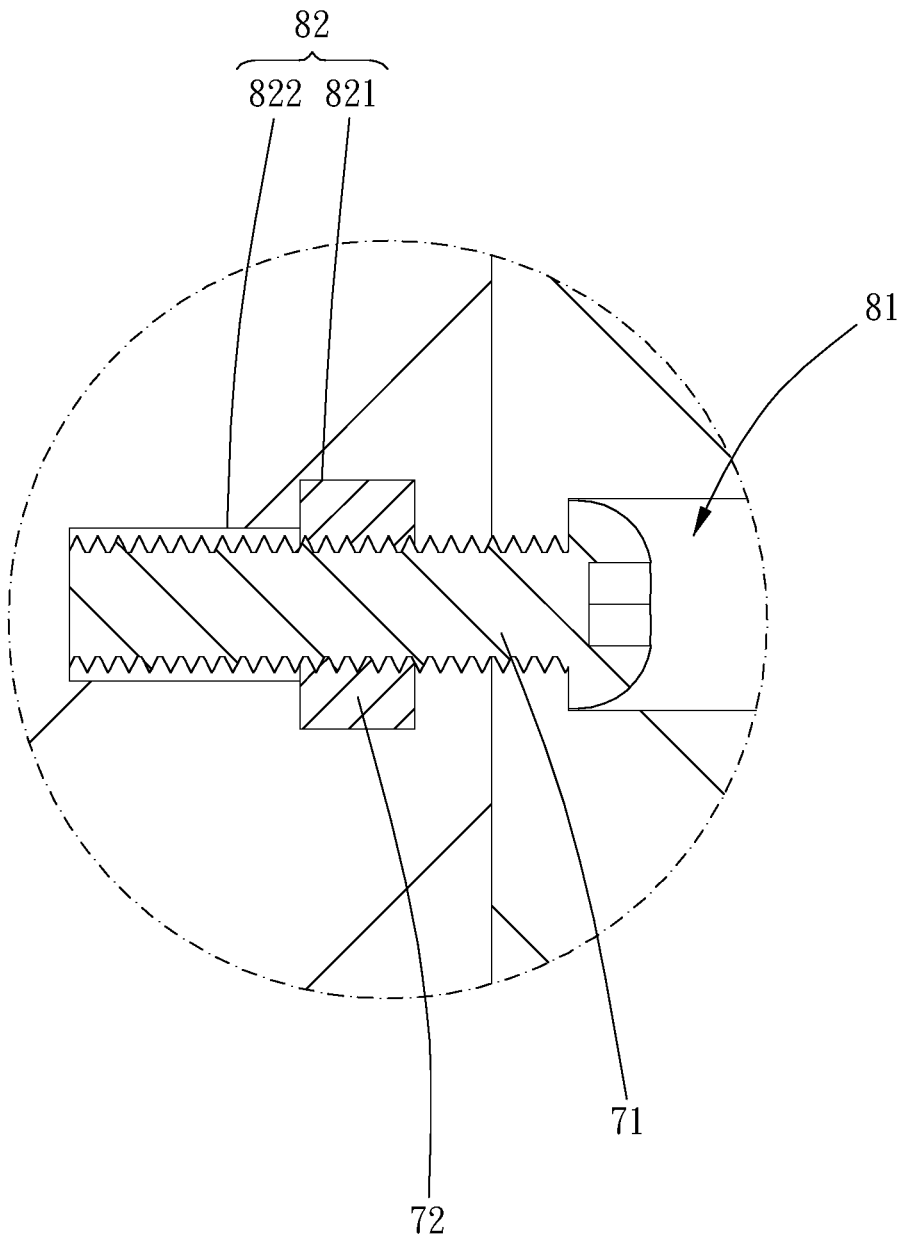
FIG. 11 is a partial enlargement of FIG. 10.
Figure 12:
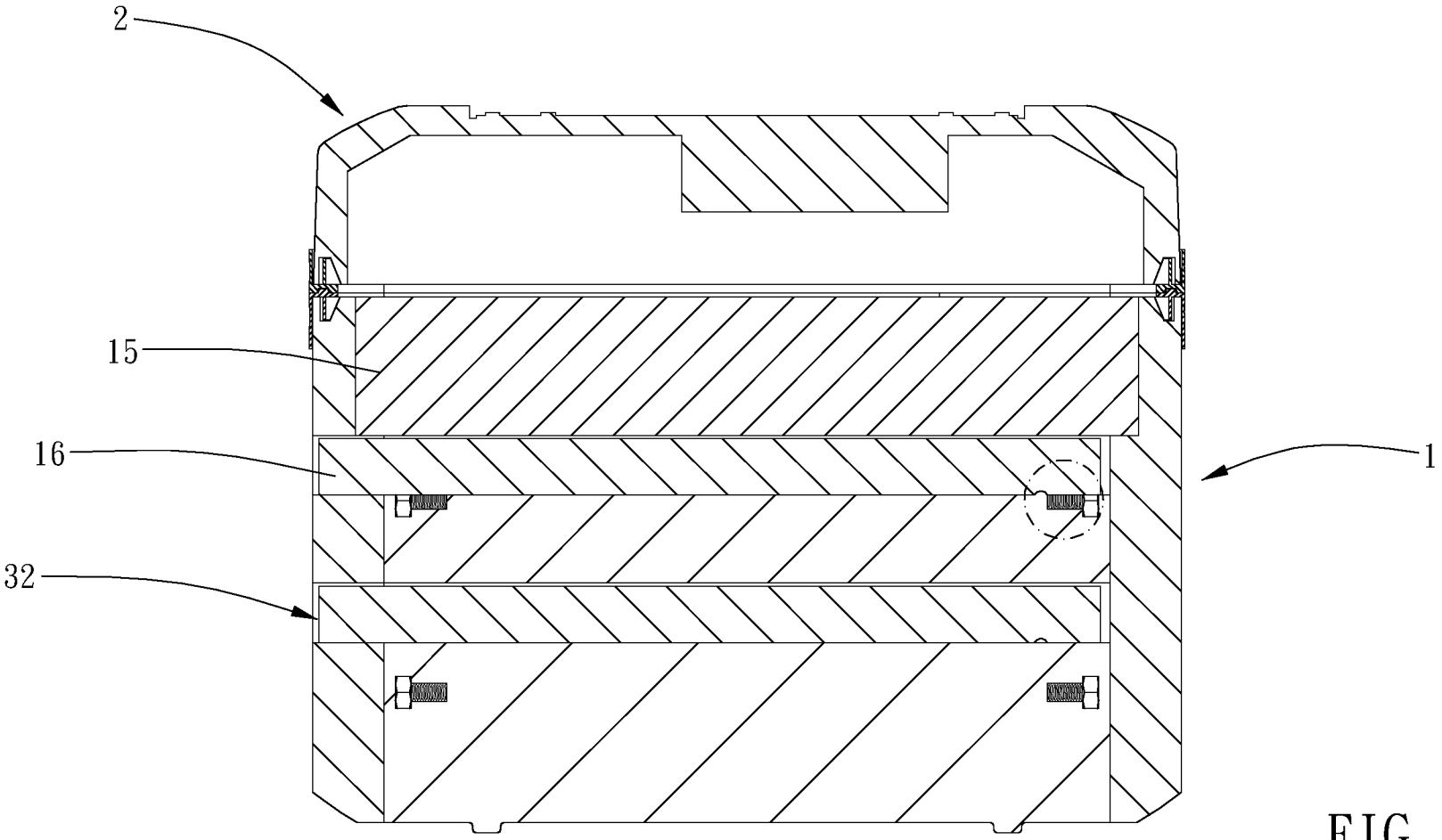
FIG. 12 is a cross-sectional view, taken along a line B-B of FIG. 1.
Figure 13:
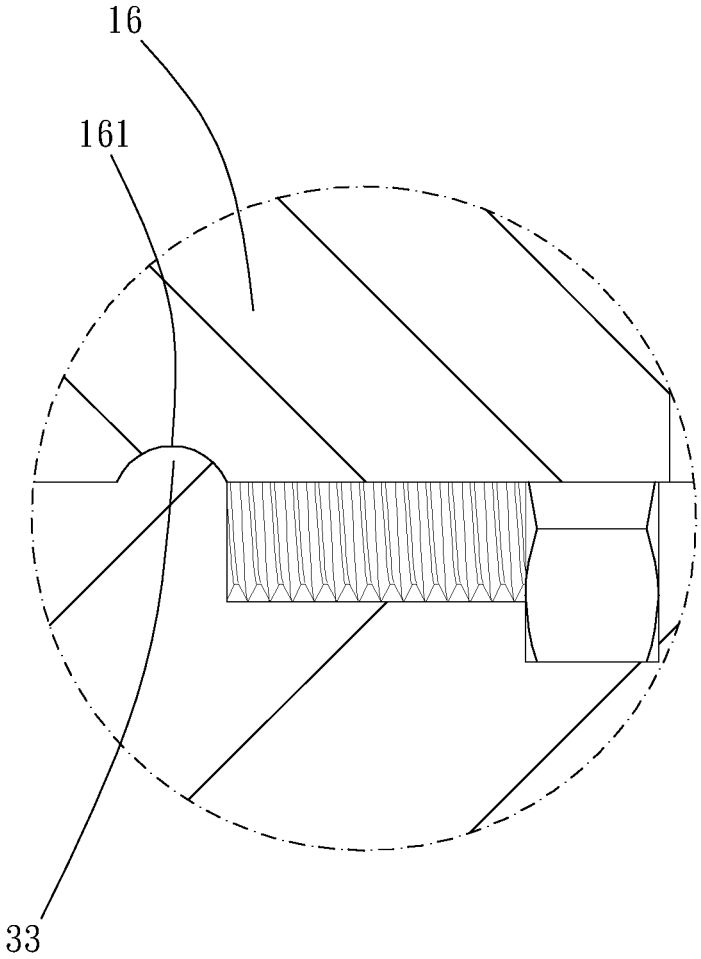
FIG. 13 is a partial enlargement of FIG. 12.

Please refer to FIGS. 1 to 12 for a preferable embodiment of the present invention. A toolbox of the present invention includes a main body 1, a lid 2 and at least one locking assembly 4.

The main body 1 includes a main frame 11, a storing tray 15, at least one drawer 16, a first flange 17 and a first frame 18. The main frame 11 define an inner space 111, a first opening 112 and a second opening 113 which are in communication with the inner space 111. The storing tray 15 is disposed on the main frame 11 and covers the first opening 112. At least one of the storing tray 15 and the main frame 11 includes an annular face 19. The first flange 17 projects from the annular face 19 in a direction toward the first opening 112. The first frame 18 includes two first side walls 181 and a first end wall 182, the two first side walls 181 are respectively connected to opposite ends of the first end wall 182 to define a first receiving room 183, the first flange 17 is inserted within the first receiving room 183, and the at least one drawer 16 is inserted within the inner space 111 via the second opening 113 and mounted to the main frame 11, wherein, the first frame 18 is made of metal, and the first flange 17 is made of plastic material.

The lid 2 is rotatably connected to the main body 1, and the lid 2 includes a second flange 21 and a second frame 22. The second frame 22 includes two second side walls 221 and a second end wall 222, the two second side walls 221 are respectively connected to opposite ends of the second end wall 222 to define a second receiving room 223, and the second flange 21 is inserted within the second receiving room 223.

One of the first end wall 182 and the second end wall 222 includes a projection 184, the other of the first end wall 182 and the second end wall 222 includes a recess 224, the projection 184 and the recess 224 have corresponding shapes, the projection 184 is tapered, and when the lid 2 and the main body 1 are closed, the projection 184 is engaged within the recess 224, wherein the projection 184 which is tapered is advantageous for insertion of the projection 184 into the recess 224.

The at least one locking assembly 4 includes a first locking unit 41, a second locking unit 42, a plurality of first positioning members 43 and a plurality of second positioning members 44, the first locking unit 41 is positioned to the first frame 18 by the plurality of first positioning members 43, the second locking unit 42 is positioned to the second frame 22 by the plurality of second positioning members 44, and the first locking unit 41 is lockable with the second locking unit 42 to releasably lock the lid 2 and the main body 1. The first frame 18 and the second frame 22 which are made of metal provides sufficient and good support to the at least one locking assembly 4, which can avoid deformation after using. The first frame 18 and the second frame 22 are preferably made of aluminum which is strong, light, and attractive.

Each said first positioning member 43 includes a first shaft 431 and two first blocking portions 432, the first shaft 431 is disposed through the first locking unit 41, the first flange 17 and the two first side walls 181, the two first blocking portions 432 are respectively connected to opposite ends the first shaft 431, and the two first blocking portions 432 are respectively blockable with the first locking unit 41 and one said first side wall 181 in a direction in which the first shaft 431 extends. In other words, the first shaft 431 is disposed through the two first side walls 181 so that the two first blocking portions 432 are both abutted against the first frame 18 which is pretty stiff, which enhances the structural strength of the first flange 17. Each said second positioning member 44 includes a second shaft 441 and two second blocking portions 442, the second shaft 441 is disposed through the second locking unit 42, the second flange 21 and the two second side walls 221, and the two second blocking portions 442 are respectively connected to opposite ends of the second shaft 441, and the two second blocking portions 442 are respectively blockable with the second locking unit 42 and one said second side wall 221 in a direction in which the second shaft 42 extends.

Preferably, the toolbox further includes a plurality of linkage assemblies 9 for restricting the lid 2 and the main body 1 under open state; each said linkage assembly 9 includes a first linkage member 91 and a second linkage member 92, an end of the first linkage member 91 is connected to the first frame 18, an end of the second linkage member 92 is connected to the second frame 22, another end of the first linkage member 91 and another end of the second linkage member 92 are rotatably connected.

Preferably, a grip 23 is connected to the lid 2, for carrying the toolbox.

Specifically, the first locking unit 41 includes a first base portion 411, a retainer 412 and a lever 415, the second locking unit 42 includes a second base portion 421 and an engaging hole 422, the first base portion 411 is connected to the main body 1 by the plurality of first positioning members 43, the second base portion 421 is connected to the lid 2 by the plurality of second positioning members 44, the lever 415 is rotatably connected to the first base portion 411, and the retainer 412 is connected to and movable with the lever 415 and is configured to securedly hoop on the second base portion 421, and the engaging hole 422 is disposed on the second base portion 421; the retainer 412 includes an annular body 413 and an engaging portion 414 connected with the annular body 413, when the annular body 413 is securedly hooped on the second base portion 421, the engaging portion 414 is engaged within the engaging hole 422. In this embodiment, the engaging portion 414 and the annular body 413 are integrally formed. For example, the engaging portion 414 is formed in a fan-shape by stamping, which provides good combination and large engagement area.

Specifically, the first locking unit 41 includes a first recessed portion 416 on a side facing toward the main body 1, and one of the two first side walls 181 adjacent to the first locking unit 41 is partially received within the first recessed portion 416, so that the first locking unit 41 can fittingly contact the main body 1 and this provides good combination. The second locking unit 42 includes a second recessed portion 423 on a side facing the lid, and one of the two second side walls 221 adjacent to the second locking unit 42 is partially received within the second recessed portion 423.

The toolbox further includes a plurality of hinges 5, each said hinge 5 includes a connection member 51, a plurality of third positioning members 52 and a plurality of fourth positioning members 53. Each said third positioning member 52 includes a third shaft 521 and two third blocking portions 522, the third shaft 521 is disposed through an end of the connection member 51, the first flange 17 and the two first side walls 181, the two third blocking portions 522 are respectively connected to opposite ends of the third shaft 521, and the two third blocking portions 522 are respectively blockable with the connection member 51 and one said first side wall 181 in a direction in which the third shaft 521 extends. Each said fourth positioning member 53 includes a fourth shaft 531 and two fourth blocking portions 532, the fourth shaft 531 is disposed through another end of the connection member 51, the second flange 21 and the two second side walls 221, the two fourth blocking portions 532 are respectively connected to opposite ends of the fourth shaft 531, and the two fourth blocking portions 532 are respectively blockable with the connection member 51 and one said second side wall 221 in a direction in which the fourth shaft 531 extends.

The main frame 11 includes a plurality of first wall parts 12 and a plurality of second wall parts 13, one of the plurality of first wall parts 12 and the plurality of second wall parts 13 includes a plurality of connection projections 61, the other of includes a plurality of connection recesses 65, and the first wall part 12 and the second wall part 13 and the plurality of connection recesses 65 are connected by engagement of the plurality of connection projections 61; the second opening 113 is disposed on and through one said first wall part 12. The main frame 11 further includes a third side wall 14, the two first side walls 181 are inserted and connected to two opposite sides of the third side wall 14, and the two second side walls 221 are inserted and connected to another two opposite sides of the third side wall 14, which is advantageous for producing parts and efficiency. Additionally, before combined, the plurality of first wall parts 12 and the plurality of second wall parts 13 can be stacked to save space for storage and to facilitate transportation.

Each said connection projection 61 includes a necked portion 62 and an enlarged portion 63 connected with the necked portion 62, each said connection recess 65 includes a necked opening 66 and an inner room 67 in communication with the necked opening 66, each said enlarged portion 63 is disposed through one said necked opening 66 and blockably engaged within one said inner room 67, and each said necked opening 66 restricts one said necked portion 62. Specifically, at least one of two opposite sides of each said enlarged portion 63 includes a lateral flange 64, each said necked opening 66 includes a narrowed section 661 and two widened sections 662 respectively connected to opposite sides of the narrowed section 661, each said enlarged portion 63 is disposed through one said necked opening 66 and blockably engaged within one said inner room 67, each said narrowed section 661 restricts one said necked portion 62, and the cooperation of the narrowed section 661 and the lateral flange 64 provide good engagement with the necked portion 62.

In this embodiment, the number of the plurality of first wall parts 12 is two, and the number of the plurality of first wall parts 12 is two. Each said first wall part 12 includes an engaging slot 121, top faces of the plurality of second wall parts 13 are aligned with a bottom of the engaging slot 121, each of opposite sides of the storing tray 15 is received within the engaging slot 121 of one said first wall part 12, each of another opposite sides of the storing tray 15 is abutted on the top face of one said second wall part 13, and a top face of the storing tray 15 and the top faces of the plurality of first wall parts 12 form the annular face 19. That is, the first flange 17 extends on the top face of the storing tray 15 and the top faces of the two first wall parts 12, and by covering of the first frame 18, the storing tray 15 and the two first wall parts 12 can be stably combined.

Specifically, the plurality of first wall parts 12 and the plurality of second wall parts 13 define a circumferential wall 31, each of two opposite sides of the circumferential wall 31 includes at least one slot 32, and each of two opposite sides of each said drawer 16 is inserted within one said slot 32. Specifically, an inner face of each said slot 32 includes a bump 33, and each of the two opposite sides of each said drawer 16 includes a concave 161 within which one said bump 33 is engageable, for further engagement.

Preferably, the main frame 11 further includes a plurality of fastening assemblies 7, and each said fastening assembly 7 includes a bolt 71 and a nut 72. One of adjacent said first and second side walls 12, 13 further includes a plurality of through holes 81, and the other of the adjacent said first and second side walls 12, 13 further includes a plurality of receiving holes 82 which respectively correspond to the plurality of through holes 81. Each said receiving hole 82 receives one said nut 72, each said bolt 71 is disposed through one said through hole 81 and within one said receiving hole 82, and the bolt 71 and the nut 72 of each of the plurality of fastening assemblies 7 fixedly secure the adjacent said first and second wall parts 12, 13. As a result, the main frame 11 is stably combined, can bear large external force or impact, and is uneasy to disengage, detach or break.

In this embodiment, each said receiving hole 82 includes a receiving section 821 receiving one said nut 72 and an extension section 822 in communication with and narrower than the receiving section 821, and each said bolt 71 is disposed through one said nut 72 and extends within one said extension section 822. Preferably, each said nut 72 is abutted laterally against an inner face of one said receiving hole 82, and a distal end of each said bolt 71 is abutted axially against an inner face of one said receiving hole 82, which sufficiently prevents the bolt 71 from loosening.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A toolbox, including:

a main body, including a main frame, a storing tray, at least one drawer, a first flange and a first frame, the main frame defining an inner space, a first opening and a second opening which are in communication with the inner space, the storing tray being disposed on the main frame and covering the first opening, at least one of the storing tray and the main frame including an annular face, the first flange projecting from the annular face in a direction toward the first opening, the first frame including two first side walls and a first end wall, the two first side walls being respectively connected to opposite ends of the first end wall to define a first receiving room, the first flange being inserted within the first receiving room, the at least one drawer being inserted within the inner space via the second opening and mounted to the main frame, the first frame being made of metal, the first flange being made of plastic material;

a lid, rotatably connected to the main body, including a second flange and a second frame, the second frame including two second side walls and a second end wall, the two second side walls being respectively connected to opposite ends of the second end wall to define a second receiving room, the second flange being inserted within the second receiving room, the second frame being made of metal, the second flange being made of plastic material; and at least one locking assembly, including a first locking unit, a second locking unit, a plurality of first positioning members and a plurality of second positioning members, the first locking unit being positioned to the first frame by the plurality of first positioning members, the second locking unit being positioned to the second frame by the plurality of second positioning members, the first locking unit being lockable with the second locking unit to releasably lock the lid and the main body;

wherein each said first positioning member including a first shaft and two first blocking portions, the first shaft being disposed through the first locking unit, the first flange and the two first side walls, the two first blocking portions being respectively connected to opposite ends of the first shaft, the two first blocking portions being respectively blockable with the first locking unit and one said first side wall in a direction in which the first shaft extends;

wherein each said second positioning member including a second shaft and two second blocking portions, the second shaft being disposed through the second locking unit, the second flange and the two second side walls, the two second blocking portions being respectively connected to opposite ends of the second shaft, the two second blocking portions being respectively blockable with the second locking unit and one of the two said second side walls in a direction in which the second shaft extends.

2. The toolbox of claim 1, wherein the first locking unit includes a first base portion, a retainer and a lever, the second locking unit includes a second base portion and an engaging hole, the first base portion is connected to the main body by the plurality of first positioning members, the second base portion is connected to the lid by the plurality of second positioning members, the lever is rotatably connected to the first base portion, the retainer is connected to and movable with the lever and is configured to securedly hoop on the second base portion, the engaging hole is disposed on the second base portion; the retainer includes an annular body and an engaging portion connected with the annular body, when the annular body is securedly hooped on the second base portion, the engaging portion is engaged within the engaging hole.

3. The toolbox of claim 1, wherein the toolbox further includes a plurality of hinges, each said hinge includes a connection member, a plurality of third positioning members and a plurality of fourth positioning members, each said third positioning member includes a third shaft and two third blocking portions, the third shaft is disposed through an end of the connection member, the first flange and the two first side walls, the two third blocking portions are respectively connected to opposite ends of the third shaft, the two third blocking portions are respectively blockable with the connection member and one said first side wall in a direction in which the third shaft extends, each said fourth positioning member includes a fourth shaft and two fourth blocking portions, the fourth shaft is disposed through another end of the connection member, the second flange and the two second side walls, the two fourth blocking portions are respectively connected to opposite ends of the fourth shaft, and the two fourth blocking portions are respectively blockable with the connection member and one of the two said second side walls in a direction in which the fourth shaft extends.

4. The toolbox of claim 1, wherein the main frame further includes a plurality of first wall parts and a plurality of second wall parts, one of the plurality of first wall parts and the plurality of second wall parts includes a plurality of connection projections, the other of the plurality of first wall parts and the plurality of second wall parts includes a plurality of connection recesses, the plurality of first wall parts and the plurality of second wall parts are connected by engagement of the plurality of connection projections and the plurality of connection recesses; the second opening is disposed on and through one said first wall part.

5. The toolbox of claim 4, wherein each said connection projection includes a necked portion and an enlarged portion connected with the necked portion, each said connection recess includes a necked opening and an inner room in communication with the necked opening, each said enlarged portion is disposed through one said necked opening and blockably engaged within one said inner room, and each said necked opening restricts one said necked portion.

6. The toolbox of claim 5, wherein at least one of two opposite sides of each said enlarged portion includes a lateral flange.

7. The toolbox of claim 4, wherein the main frame further includes a plurality of fastening assemblies, each said fastening assembly includes a bolt and a nut, one of adjacent said first and second side walls further includes a plurality of through holes, and the other of the adjacent said first and second side walls further includes a plurality of receiving holes which respectively correspond to the plurality of through holes, each said receiving hole receives one said nut, each said bolt is disposed through one said through hole and within one said receiving hole, and the bolt and the nut of each of the plurality of fastening assemblies fixedly secure the adjacent said first and second wall parts.

8. The toolbox of claim 1, wherein the first locking unit includes a first recessed portion on a side facing toward the main body, and one of the two first side walls adjacent to the first locking unit is partially received within the first recessed portion; the second locking unit includes a second recessed portion on a side facing the lid, and one of the two second side walls adjacent to the second locking unit is partially received within the second recessed portion.

9. The toolbox of claim 1, wherein one of the first end wall and the second end wall includes a projection, the other of the first end wall and the second end wall includes a recess, the projection and the recess have corresponding shapes, the projection and the recess are both tapered, and when the lid and the main body are closed, the projection is engaged within the recess.

10. The toolbox of claim 6, wherein the first locking unit includes a first base portion, a retainer and a lever, the second locking unit includes a second base portion and an engaging hole, the first base portion is connected to the main body by the plurality of first positioning members, the second base portion is connected to the lid by the plurality of second positioning members, the lever is rotatably connected to the first base portion, the retainer is connected to and movable with the lever and is configured to securedly hoop on the second base portion, the engaging hole is disposed on the second base portion; the retainer includes an annular body and an engaging portion connected with the annular body, when the annular body is securedly hooped on the second base portion, the engaging portion is engaged within the engaging hole; the toolbox further includes a plurality of hinges, each said hinge includes a connection member, a plurality of third positioning members and a plurality of fourth positioning members, each said third positioning member includes a third shaft and two third blocking portions, the third shaft is disposed through an end of the connection member, the first flange and the two first side walls, the two third blocking portions are respectively connected to opposite ends of the third shaft, the two third blocking portions are respectively blockable with the connection member and one said first side wall in a direction in which the third shaft extends, each said fourth positioning member includes a fourth shaft and two fourth blocking portions, the fourth shaft is disposed through another end of the connection member, the second flange and the two second side walls, the two fourth blocking portions are respectively connected to opposite ends of the fourth shaft, and the two fourth blocking portions are respectively blockable with the connection member and one of the two said second side walls in a direction in which the fourth shaft extends; the main frame further includes a plurality of fastening assemblies, each said fastening assembly includes a bolt and a nut, one of adjacent said first and second side walls further includes a plurality of through holes, and the other of the adjacent said first and second side walls further includes a plurality of receiving holes which respectively correspond to the plurality of through holes, each said receiving hole receives one said nut, each said bolt is disposed through one said through hole and within one said receiving hole, and the bolt and the nut of each of the plurality of fastening assemblies fixedly secure the adjacent said first and second wall parts; the first locking unit includes a first recessed portion on a side facing toward the main body, and one of the two first side walls adjacent to the first locking unit is partially received within the first recessed portion; the second locking unit includes a second recessed portion on a side facing the lid, and one of the two second side walls adjacent to the second locking unit is partially received within the second recessed portion; one of the first end wall and the second end wall includes a projection, the other of the first end wall and the second end wall includes a recess, the projection and the recess have corresponding shapes, the projection and the recess are both tapered, and when the lid and the main body are closed, the projection is engaged within the recess; the plurality of first side walls and the plurality of second side walls define a circumferential wall, each of two opposite sides of the circumferential wall includes at least one slot, and each of two opposite sides of each said drawer is inserted within one said slot; an inner face of each said slot includes a bump, and each of the two opposite sides of each said drawer includes a concave within which one said bump is engageable; a distal end of each said bolt is abutted axially against an inner face of one said receiving hole; each said necked opening includes a narrowed section and two widened sections respectively connected to opposite sides of the narrowed section, each said enlarged portion is disposed through one said necked opening and blockably engaged within one said inner room, each said narrowed section restricts one said necked portion; the main frame further includes a third side wall, the two first side walls are inserted and connected to two opposite sides of the third side wall, the two second side walls are inserted and connected to another two opposite sides of the third side wall; each said nut is abutted laterally against an inner face of one said receiving hole; each said receiving hole includes a receiving section receiving one said nut and an extension section in communication with and narrower than the receiving section, and each said bolt is disposed through one said nut and extends within one said extension section; a grip is connected to the lid; the engaging portion and the annular body are integrally formed, the engaging portion is formed in a fan-shape by stamping; the number of the plurality of first wall parts is two, the number of the plurality of first wall parts is two, each said first wall part includes an engaging slot, top faces of the plurality of second wall parts are aligned with a bottom of the engaging slot, each of opposite sides of the storing tray is received within the engaging slot of one said first wall part, each of another opposite sides of the storing tray is abutted on the top face of one said second wall part, a top face of the storing tray and the top faces of the plurality of first wall parts form the annular face; the toolbox further includes a plurality of linkage assemblies, each said linkage assembly includes a first linkage member and a second linkage member, an end of the first linkage member is connected to the first frame, an end of the second linkage member is connected to the second frame, the first linkage member and the second linkage member are rotatably connected.

* * * * *